US006176732B1

(12) United States Patent
Schultz et al.

(10) Patent No.: US 6,176,732 B1
(45) Date of Patent: Jan. 23, 2001

(54) SIMULTANEOUS WIRE PAIR TERMINATOR

(75) Inventors: Jeff Schultz, Fort Wayne; John K. Marsh, Wolcottville, both of IN (US)

(73) Assignee: Dekko Engineering, Inc., Kendallville, IN (US)

( * ) Notice: Under 35 U.S.C. 154(b), the term of this patent shall be extended for 0 days.

(21) Appl. No.: 09/328,282

(22) Filed: Jun. 8, 1999

(51) Int. Cl.[7] ..... H01R 4/26
(52) U.S. Cl. ..... 439/404
(58) Field of Search ..... 439/404, 828, 439/835, 395; 29/749

(56) References Cited

U.S. PATENT DOCUMENTS 5,655,284 * 8/1997 Ferrill et al. ..... 29/566.3
5,888,100 * 3/1999 Bofill et al. ..... 439/676

FOREIGN PATENT DOCUMENTS 2 233 585A * 1/1991 (GB) ..... 29/749

* cited by examiner

*Primary Examiner*—Renee Luebke
*Assistant Examiner*—Briggitte R. Hammond
(74) *Attorney, Agent, or Firm*—Taylor & Aust, P.C.

(57) ABSTRACT

A wire terminator assembly is for connecting a plurality of wires to an electrical connector having a plurality of terminals. The wire terminator assembly includes two terminator blades slidably retained within a base unit. Each terminator blade is configured for connecting a respective one of the wires to a respective one of the terminals of the electrical connector. A drive unit is configured for simultaneously sliding each of the terminator blades within the base unit to thereby connect the wires to the electrical connector.

13 Claims, 5 Drawing Sheets

SIMULTANEOUS WIRE PAIR TERMINATOR

BACKGROUND OF THE INVENTION

1. Field of the Invention

The present invention relates to a wire terminator, and, more particularly, to a wire terminator for connecting wires to the terminals of an electrical connector.

2. Description of the Related Art

It is known to connect wires to an electrical connector by individually pressing each wire onto a respective terminal of the electrical connector. Each terminal has a pair of sharp edges between which the wire is pressed. The sharp edges pierce the insulation surrounding the wire and thereby make electrical contact with the internal electrical conductor. Such a connector is known as an "insulation displacement" connector. Before being connected to the electrical connector, adjacent wires are twisted together in pairs in order to reduce crosstalk between the wires. The ends of each twisted wire pair are left untwisted so that they may be individually and sequentially inserted into a wire terminating apparatus.

The untwisted end of one of the wires of the twisted wire pair is pulled into the wire terminating apparatus such that the untwisted end of the wire engages a leading edge of a terminator blade within the apparatus. The terminator blade is then actuated to push the wire end into the terminal of the electrical connector. After the terminator blade has been retracted to its original position, and the wire end has been attached to the terminal, the terminator blade is then aligned with a second terminal of the electrical connector, with the second terminal being adjacent to the first terminal. The untwisted end of the second wire of the twisted wire pair is then pulled into the wire terminating apparatus, similarly to the first wire, such that the untwisted end of the second wire engages the leading edge of the terminator blade. The terminator blade is then again actuated to push the second wire end into the second terminal of the electrical connector.

A problem is that, for a couple of different reasons, a substantial length of the wire ends is left untwisted. One of the reasons is to avoid the second wire interfering with the connection of the first wire to the connector terminal. That is, the longer the length of untwisted wire ends, the further the second wire end can be pulled from the first wire end while the first wire end is being connected. Another reason is to provide slack for the travel distance of the terminator blade, particularly after the first wire end has been connected to the terminal and the second wire is being inserted into the terminating apparatus. A large travel distance for the terminator blade has the advantage of providing a larger space between the terminator blade and the electrical connector in which the wires can be threaded into the terminating apparatus, thus making operation of the terminating apparatus easier and quicker. However, the large travel distance has the disadvantage of requiring that the length of untwisted wire ends be longer, which results in more crosstalk between the wires.

Yet another problem associated with individual termination of the wire ends is that it causes the wire ends to have different lengths. In order to avoid electrical interference, it is very important that the spacing between the wires is consistent and that the two wires of the pair are of the same length.

SUMMARY OF THE INVENTION

The present invention provides a wire terminator assembly which can simultaneously connect both wires of a twisted wire pair to respective terminals of an electrical connector.

The invention comprises, in one form thereof, a wire terminator assembly for connecting a plurality of wires to an electrical connector having a plurality of terminals. The wire terminator assembly includes two terminator blades slidably retained within a base unit. Each terminator blade is configured for connecting a respective one of the wires to a respective one of the terminals of the electrical connector. A drive unit is configured for simultaneously sliding each of the terminator blades within the base unit to thereby connect the wires to the electrical connector.

An advantage of the present invention is that both wires of a twisted wire pair can be simultaneously connected to an electrical connector.

Another advantage is that the lengths of the untwisted ends of the twisted wire pair are reduced, thereby minimizing crosstalk between the wires.

Yet another advantage is that by connecting two wires at a time instead of one, a group of wires can be connected the electrical connector more quickly.

A further advantage is that both wires of the pair have the same length, thus reducing loops that otherwise occur when wires are individually terminated.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
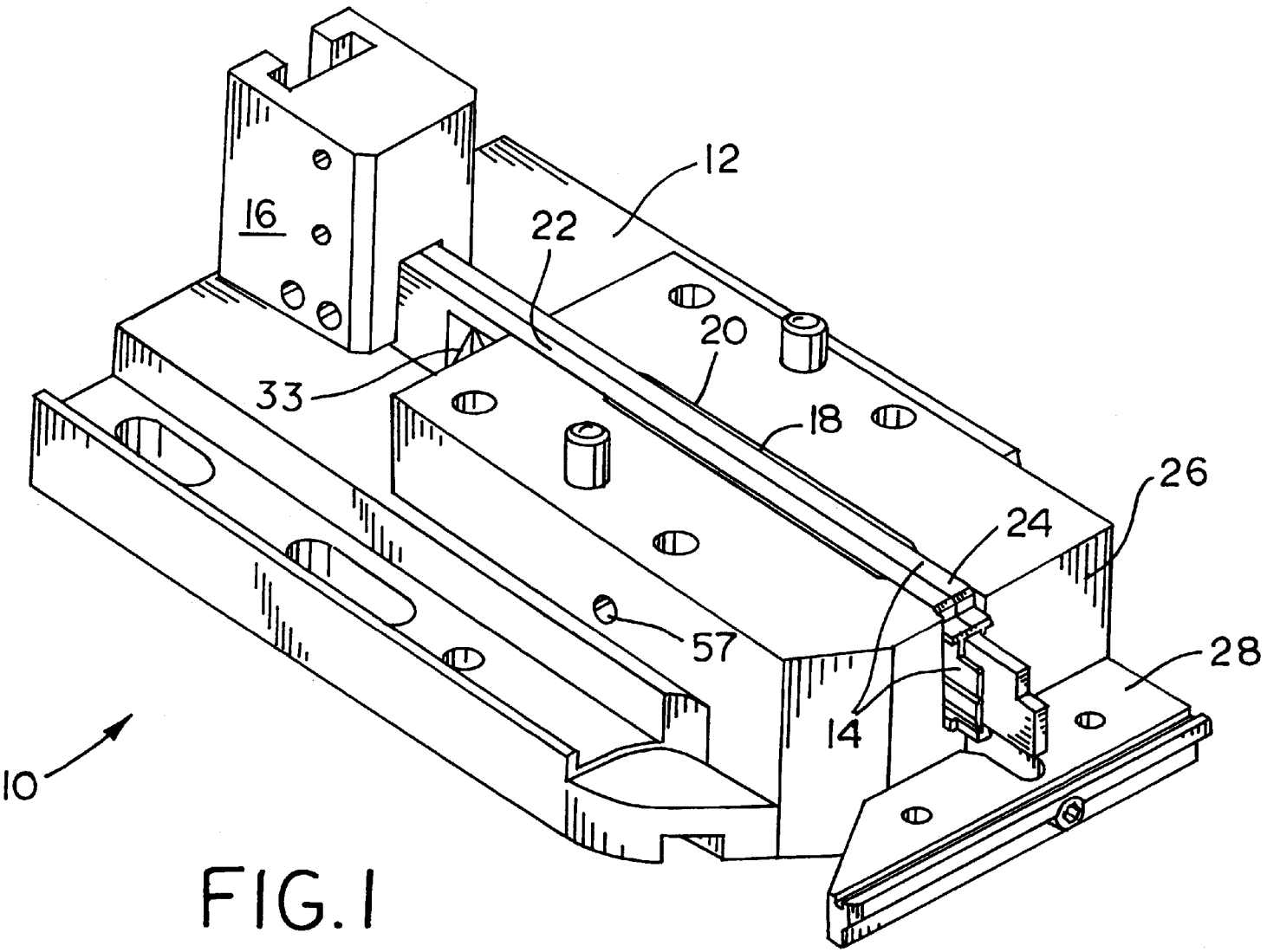
FIG. 1 is a perspective view of one embodiment of a simultaneous wire pair terminator of the present invention.

Referring now to the drawings, and particularly to FIG. 1, there is shown one embodiment of a wire terminator assembly 10 of the present invention including a base unit 12, terminator blades 14 and a drive unit 16.

Figure 2:
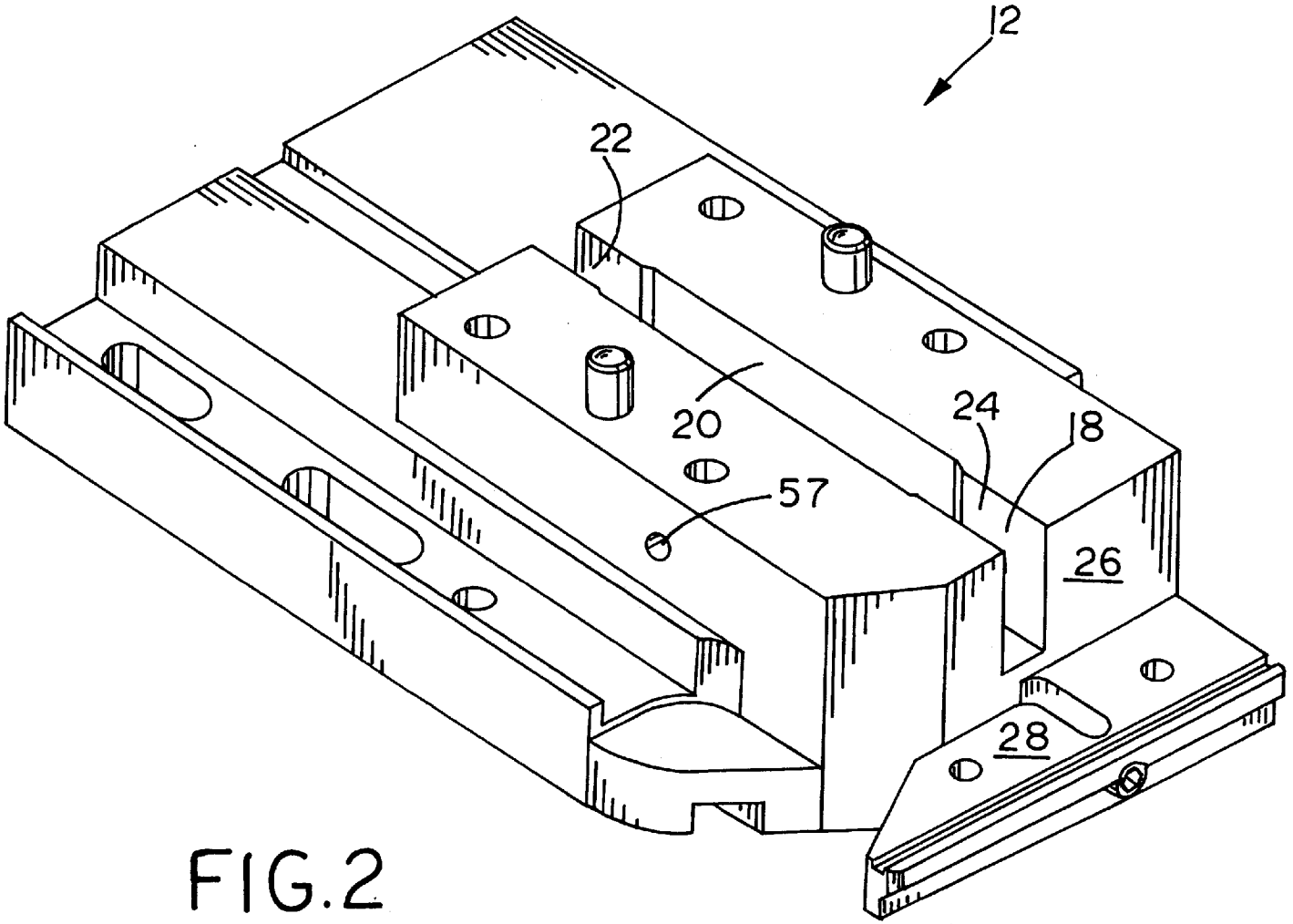
FIG. 2 is a perspective view of the base unit of FIG. 1.
Figure 6:
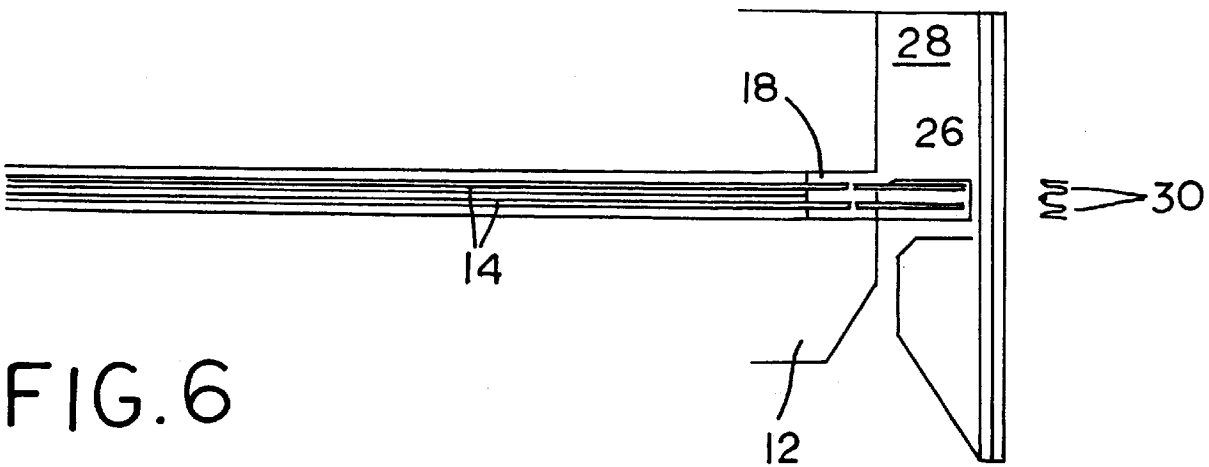
FIG. 6 is a fragmentary top view of the terminator blades and the base unit of FIG. 1.

Base unit 12, best seen in FIG. 2, includes a channel 18 in which terminator blades 14 are slidingly received. Channel 18 has a widened area 20 in which base 12 is separated from contact blades 14, thereby reducing friction therebetween. Channel 18 also has a rear narrow portion 22 and a front narrow portion 24 which work in conjunction to retain blades 14 in alignment. Base unit 12 also includes a front face 26 from which blades 14 extend out of channel 18. An adapter portion 28 interfaces with an electrical connector (not shown) so that blades 14 can be aligned with respective pins or terminals 30 (FIG. 6) of the electrical connector.

Figure 3:
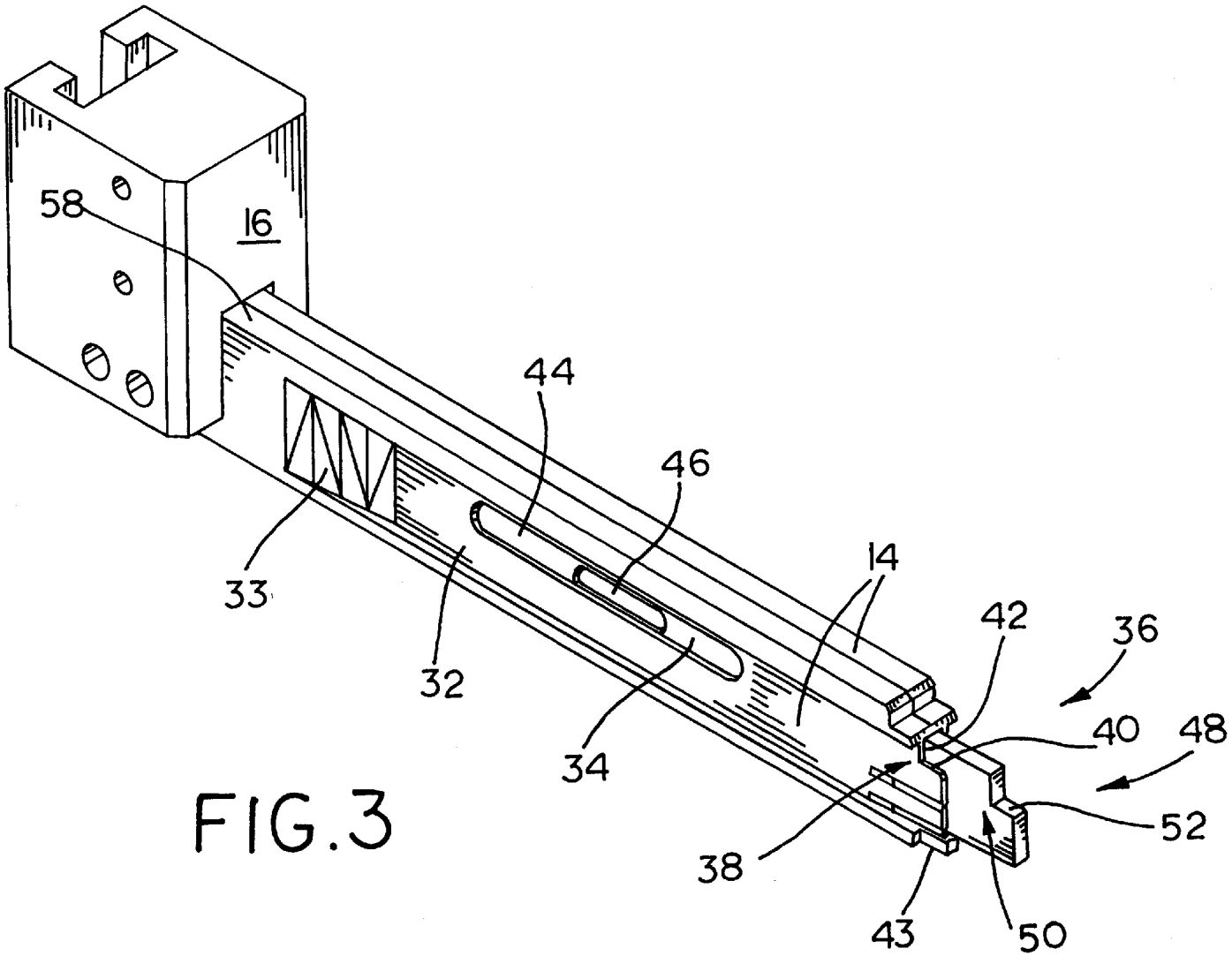
FIG. 3 is a perspective view of the terminator blades, the spacer blade and the drive unit of FIG. 1.

Terminator blades 14, shown assembled to drive unit 16 in FIG. 3, each include a recessed area 32 with a beveled surface 33 and a slot 34. Front ends or leading edges 36 of terminator blades 14 each include a shoulder 38 with a substantially horizontal edge 40 and a substantially vertical edge 42. Each terminator blade 14 can include a sharp bottom cutting edge 43. A spacer blade 44 (FIG. 5) is disposed between terminator blades 14 and is received in recessed areas 32. Spacer blade 44 includes a slot 46 which can be at least partially aligned with slots 34 of blades 14. Front end or leading edge 48 of spacer blade 44 includes a shoulder 50 with a substantially horizontal edge 52 and a substantially vertical edge 54.

A pin 56 is received in a through hole 57 which extends through base 12 on one or both sides of channel 18. Pin 56 extends across channel 18 and through slots 34 and 46 of terminator blades 14 and spacer blade 44, respectively.

Pneumatic drive unit 16 includes a notch 58 receiving terminator blades 14. Drive 16 is placed over an air cylinder adapter (not shown) for actuating sliding movement of blades 14 within channel 18.

Figure 5:
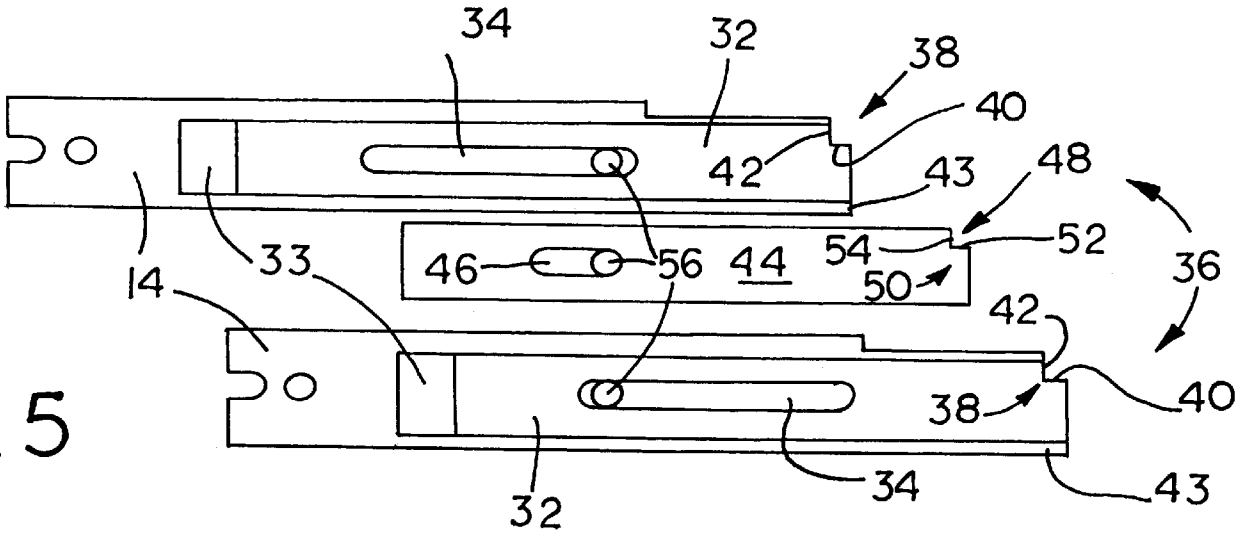
FIG. 5 is an exploded side view of the terminator blades and the spacer blade of the simultaneous wire pair terminator of FIG. 1.

In operation, drive unit 16 slides terminator blades 14 and spacer blade 44 rearward in channel 18. Slots 34 allow leading edges 36 of terminator blades 14 to be moved further back in channel 18 than slot 46 allows leading edge 48 of spacer blade 44 to be moved. Thus, when terminator blades 14 and spacer blade 44 are in a rearward position, as best seen in FIG. 5, leading edge 48 of spacer blade 44 extends past front face 26, while leading edges 36 of terminator blades 14 are recessed within channel 18.

Figure 4:
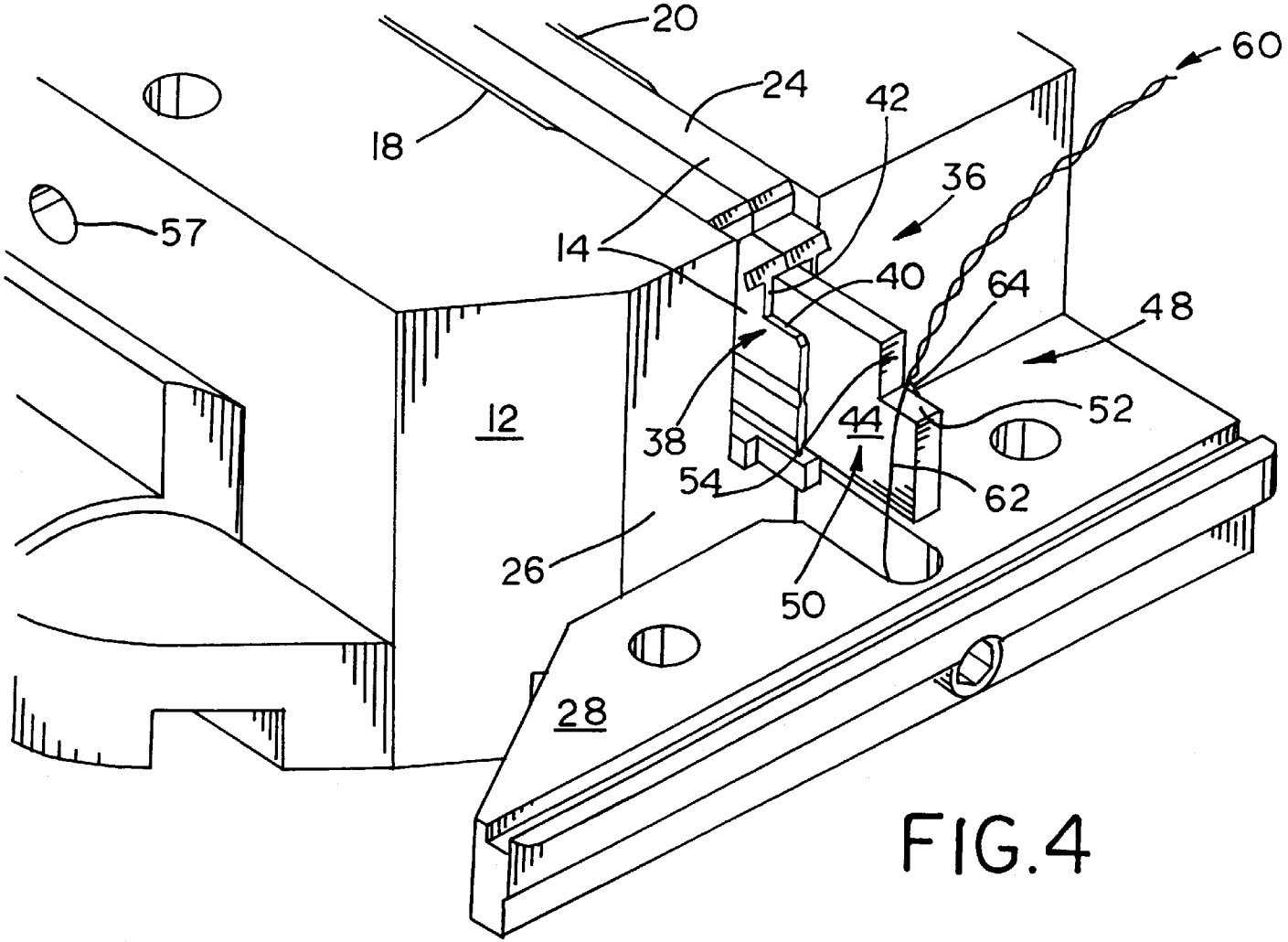
FIG. 4 is an enlarged, fragmentary view of the simultaneous wire pair terminator of FIG. 1 engaging a twisted wire pair.

A twisted wire pair 60 (FIG. 4) is placed on horizontal edge 52 of shoulder 50 of spacer blade 44 such that each of two untwisted wire ends 62 and 64 falls adjacent to a separate side of spacer blade 44. In this position, spacer blade 44 holds wire ends 62 and 64 at a predetermined vertical level such that wire ends may be engaged by shoulders 38 of terminator blades 14.

Drive unit 16 then slides terminator blades 14 forward in channel 18 toward terminals 30 of the electrical connector (not shown). As blades 14 move forward, vertical edges 42 of blades 14, as well as vertical edge 54 of spacer blade 44, engage wire ends 62 and 64. Also occurring as blades 14 move forward, their beveled surfaces 33 engage spacer blade 44, thereby carrying spacer blade 44 forward for a distance limited by the length of slot 46. Pin 56, in conjunction with slots 34 and 46, limits the longitudinal sliding movement of both terminator blades 14 and spacer blade 44.

After spacer blade 44 has moved to its most forward position, each terminator blade 14 continues to move respective wire 62 or 64 of the wire pair 60 toward the electrical connector, thereby causing spacer blade 44 to lose contact with wire ends 62 and 64. Spacer blade 44 ensures that each of wire ends 62 and 64 falls over a separate, respective one of shoulders 38, thereby preventing both wire ends 62 and 64 from being connected to a same terminal 30.

The electrical connector interfaces with adapter 28 such that terminals 30 are each aligned with a respective one of terminator blades 14. Blades 14 continue to push wire ends 62 and 64 forward into respective terminals 30. As wire ends 62 and 64 are pushed forward, the cutting edges of terminals 30 pierce the insulation surrounding wire ends 62 and 64 until terminals 30 make electrical contact with the electrical conductors within wire ends 62 and 64.

At some point along the forward progression of terminator blades 14, bottom cutting edges 43 of blades 14 can be used to cut off the tips of wire ends 62 and 64 against adapter portion 28. Thus, after attachment to the electrical connector, wire ends 62 and 64 do not extend downward past terminals 30 for a substantial distance.

After wire ends 62 and 64 have been fully attached to respective terminals 30, drive unit 16 can again move terminator blades 14 rearward in channel 18, in a direction away from the electrical connector. The electrical connector can then be moved laterally in order to align each of another two terminals 30 with a respective one of terminator blades 14. The above-described process is then cyclically repeated until all remaining wires have been attached to the electrical connector.

Wire terminator assembly 10 is shown as including two terminator blades 14. However, it is to be understood that it is possible for terminator assembly 10 to include more than two terminator blades 14 for simultaneously terminating a corresponding number of wires. Further, it is possible for drive unit 16 to be powered other than pneumatically. For example, drive unit 16 may be hydraulic, manually actuated or mechanically driven by gears.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wire terminator assembly for connecting a plurality of wires to an electrical connector having a plurality of terminals, said wire terminator assembly comprising:

a base unit;

two terminator blades slidably retained within said base unit, each terminator blade being configured for connecting a respective one of the wires to a respective one of the terminals of the electrical connector;

a spacer blade disposed between said terminator blades; and a drive unit configured for simultaneously sliding each of said terminator blades within said base unit to thereby connect the wires to the electrical connector.

2. The wire terminator assembly of claim 1, wherein each said terminator blade includes a shoulder configured for supporting a respective one of the wires.

3. The wire terminator assembly of claim 1, wherein said terminator blades are disposed in side by side relationship within said base unit.

4. The wire terminator assembly of claim 3, wherein said base unit includes a channel, said terminator blades being received within said channel.

5. A wire terminator assembly for connecting a plurality of wires to an electrical connector having a plurality of terminals, said wire terminator assembly further comprising:

a base unit;

two terminator blades slidably retained within said base unit, each terminator blade being configured for connecting a respective one of the wires to a respective one of the terminals of the electrical connector;

a spacer blade disposed between said two terminator blades, said spacer blade being configured for sliding along with said terminator blades; and a drive unit configured for simultaneously sliding each of said terminator blades within said base unit to thereby connect the wires to the electrical connector.

6. The wire terminator assembly of claim 5, wherein at least one said terminator blade includes a recess configured for receiving said spacer blade.

7. The wire terminator assembly of claim 5, wherein each of said terminator blades and said spacer blade includes a slot, said wire terminator assembly further comprising a pin extending through each of said slots, said pin and said slots conjunctively defining a means for limiting sliding movement of said terminator blades and of said spacer blade.

8. A wire terminator assembly for connecting a plurality of wires to an electrical connector having a plurality of terminals, said wire terminator assembly comprising:

a base unit;

at least two terminator blades slidably retained within said base unit, each terminator blade being configured for connecting a respective one of the wires to a respective one of the terminals of the electrical connector;

a spacer blade disposed between said terminator blades; and a drive unit configured for simultaneously sliding each of said terminator blades within said base unit to thereby connect the wires to the electrical connector.

9. A method of connecting a plurality of wires to a plurality of terminals of an electrical connector, said method comprising the steps of:

providing each of two of the wires with a respective first portion and a respective second portion, said first portions of the two wires being twisted around each other, said second portions of the two wires being untwisted;

slidably retaining two terminator blades within a base unit;

providing a spacer blade between said terminator blades;

separating the second portions by placing each second portion on a separate side of said spacer blade; and simultaneously sliding each of said terminator blades with a drive unit such that each said terminator blade presses a respective one of the second portions of the two twisted wires against a respective one of the terminals of the electrical connector.

10. The method of claim 9, wherein said simultaneously sliding step includes piercing respective layers of insulation surrounding respective ones of the two twisted wires with respective ones of the connector terminals such that each of the two twisted wires is electrically connected to a respective one of the connector terminals.

11. The method of claim 9, wherein said simultaneously sliding step includes attaching a respective one of the second portions of the two twisted wires to a respective one of the terminals of the electrical connector.

12. The method of claim 9, wherein each said terminator blade includes a shoulder, said method comprising the further steps of:

supporting each of the second portions of the two twisted wires with a respective said shoulder of a respective said terminator blade; and pulling a distal end of each said second portion of the two twisted wires such that each said second portion is held taut against a respective said terminal blade shoulder.

13. The method of claim 12, wherein said simultaneously sliding step includes cutting off the distal ends of the two twisted wires.

* * * * *